US010196235B2

(12) United States Patent
Silvennoinen et al.

(10) Patent No.: US 10,196,235 B2
(45) Date of Patent: Feb. 5, 2019

(54) GENERATING DESTINATION CALLS FOR AN ELEVATOR SYSTEM

(71) Applicant: KONE Corporation, Helsinki (FI)

(72) Inventors: Henry Silvennoinen, Helsinki (FI); Jukka Salmikuukka, Espoo (FI); Mika Belov, Tuusula (FI)

(73) Assignee: KONE CORPORATION, Helsinki (FI)

( * ) Notice: Subject to any disclaimer, the term of this patent is extended or adjusted under 35 U.S.C. 154(b) by 488 days.

(21) Appl. No.: 14/965,564

(22) Filed: Dec. 10, 2015

(65) Prior Publication Data

US 2016/0090271 A1 Mar. 31, 2016

Related U.S. Application Data

(63) Continuation of application No. PCT/FI2014/050530, filed on Jun. 26, 2014.

(30) Foreign Application Priority Data

Jul. 29, 2013 (FI) ..... 20135798

(51) Int. Cl.
*B66B 1/16* (2006.01)
*B66B 1/46* (2006.01)

(52) U.S. Cl.
CPC ..... *B66B 1/468* (2013.01); *B66B 2201/103* (2013.01); *B66B 2201/4615* (2013.01); *B66B 2201/4653* (2013.01); *B66B 2201/4676* (2013.01)

(58) Field of Classification Search
CPC ..... B66B 1/468; B66B 2201/4615; B66B 2201/4653; B66B 2201/103; B66B 2201/4676
USPC ..... 187/247, 380–389, 391, 392, 393
See application file for complete search history.

(56) References Cited

U.S. PATENT DOCUMENTS 5,949,037 A 9/1999 Oya
5,952,626 A 9/1999 Zaharia
6,109,396 A * 8/2000 Sirag ..... B66B 1/468 187/381
8,061,485 B2 * 11/2011 Finschi ..... B66B 1/468 187/384
8,490,754 B2 * 7/2013 Amano ..... B66B 1/2458 187/384

(Continued)

FOREIGN PATENT DOCUMENTS

JP 2007-320758 A 12/2007
WO WO 2006/082273 A1 8/2006

(Continued)

*Primary Examiner* — Anthony Salata
(74) *Attorney, Agent, or Firm* — Birch, Stewart, Kolasch & Birch, LLP

(57) ABSTRACT

A method and a system for generating destination calls for an elevator system is described, wherein a passenger can give personal destination calls with his/her terminal device as well as on the basis of identification of the person in at least one identification point. A passenger is identified at an identification point, on the basis of which the home floor of the passenger is determined and a destination call to the home floor is generated for the elevator system if the passenger does not have a valid destination call at the time of identification.

15 Claims, 1 Drawing Sheet

(56) References Cited

U.S. PATENT DOCUMENTS

| | | | | |
|---|---|---|---|---|
| 8,544,612 | B2 * | 10/2013 | Korhonen | B66B 1/468 187/387 |
| 8,939,263 | B2 * | 1/2015 | Tokura | B66B 1/2458 187/382 |
| 9,238,568 | B2 * | 1/2016 | Nonami | B66B 1/468 |
| 9,323,232 | B2 * | 4/2016 | Blom | H04W 4/029 |
| 9,463,954 | B2 * | 10/2016 | Kumar | B66B 1/468 |
| 9,878,874 | B2 * | 1/2018 | Kondo | B66B 1/468 |
| 2006/0065490 | A1 | 3/2006 | Zaharia et al. | |
| 2008/0011557 | A1 | 1/2008 | Hakala et al. | |
| 2012/0037461 | A1 | 2/2012 | Finschi | |
| 2012/0211309 | A1 | 8/2012 | Tokura | |
| 2016/0031676 | A1 * | 2/2016 | Haipus | B66B 1/468 187/247 |
| 2016/0251198 | A1 * | 9/2016 | Salmikuukka | B66B 1/2458 187/388 |
| 2017/0001830 | A1 * | 1/2017 | Makilaurila | B66B 1/468 |
| 2018/0072535 | A1 * | 3/2018 | Hiltunen | B66B 1/468 |

FOREIGN PATENT DOCUMENTS

| | | | |
|---|---|---|---|
| WO | WO 2007/026042 | A2 | 3/2007 |
| WO | WO 2008/116963 | A1 | 10/2008 |
| WO | WO 2011/009357 | A1 | 1/2011 |
| WO | WO 2014/049201 | A1 | 4/2014 |
| WO | WO 2014/076369 | A1 | 5/2014 |
| WO | WO 2014/096529 | A1 | 6/2014 |

* cited by examiner

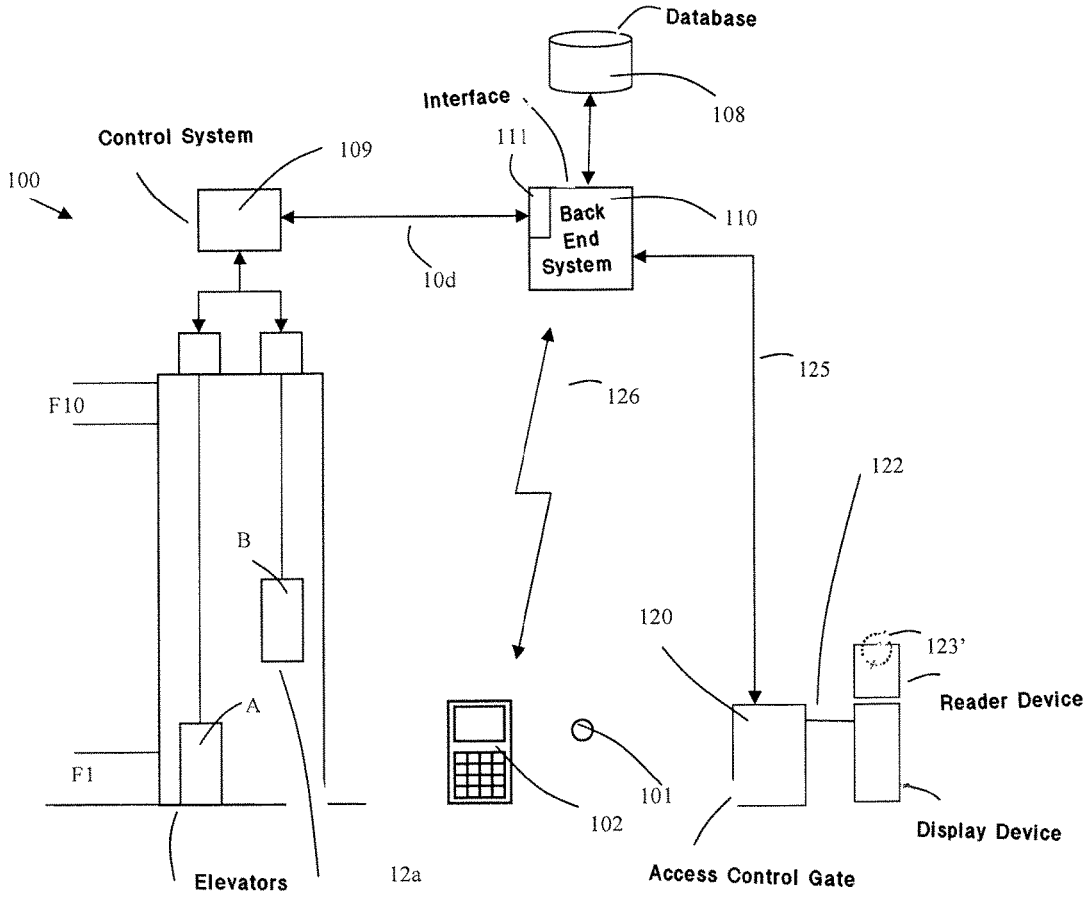
Database
108
Interface
111
Control System
109
100
Back End System
110
10d
125
126
F10
122
B
120
123'
Reader Device
A
F1
101
102
Display Device
Elevators
12a
Access Control Gate

GENERATING DESTINATION CALLS FOR AN ELEVATOR SYSTEM

CROSS REFERENCE TO RELATED APPLICATIONS

This application is a Continuation of PCT International Application No. PCT/FI2014/050530, filed on Jun. 26, 2014, which claims priority under 35 U.S.C. 119(a) to Patent Application No. 20135798, filed in Finland on Jul. 29, 2013, all of which are hereby expressly incorporated by reference into the present application.

The invention relates to a method and a system for generating destination calls for an elevator system, using a terminal device or an identifier.

BACKGROUND OF THE INVENTION

Electrical identifiers and separate terminal devices for giving passenger-specific destination calls are used to a constantly increasing extent in elevator systems. When a person takes an identifier that is in his/her possession to a reader device that is in connection with an elevator system or with a special access control system, the system reads the content, e.g. an individual ID code, of the identifier and determines on the basis of it the destination floor of the passenger, the so-called home floor. The home floor data is transmitted to the elevator system as a destination call for allocating an elevator to the person identified by the identifier. The elevator allocated to him/her is shown to the passenger with a display device that is in connection with the reader device, using which elevator the passenger will get to his/her home floor. Alternatively a passenger can have a terminal device, e.g. a mobile phone, which wirelessly sends an ID code to the elevator system or access control system and on the basis of which he/she can be identified and an elevator to the aforementioned home floor can be allocated. It is also possible that a passenger gives a destination call to a floor other than the home floor, e.g. by keying in the floor number from a user interface of the terminal device.

Often access control, with which the entry of people to the spaces in a building is restricted, is connected to call-giving based on identification. An access control system typically comprises a plurality of access gates, an automatic door or other corresponding devices, with which persons not possessing an access right required for entry can be prevented from entering a controlled space. When a person takes his/her identifier e.g. to a reader device that is in connection with an access gate, the access control system reads the content of the identifier and checks whether the person has a valid access right from the access gate. If the access right is valid, the locking of the access gate opens and the person can move into the space separated by the access gate. At the same time the access control system can send to the elevator system a destination call for taking the person to his/her home floor. It is possible that a person will be identified at a number of different access control points in the building and that a number of destination calls will be generated for the passenger to the home floor or to other floors in the manner described above. If the elevator system serves all the extra destination calls, a decline in the transportation capacity is inevitable in the elevator system, as also is a decrease in the service level of the other passengers, inter alia as longer waiting times.

AIM OF THE INVENTION

The aim of the present invention is to eliminate or at least to alleviate the drawbacks presented above that occur in prior-art solutions. More particularly by means of the invention it is desired to prevent the generation of extra destination calls when using a personal identifier or terminal device for giving a destination call.

SUMMARY OF THE INVENTION

Embodiments of the method and system of the present invention are defined by the appended claims. Some inventive embodiments are also presented in the descriptive section and in the drawings of the present application. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

The present invention discloses a method for generating destination calls for an elevator system, in which method a passenger can give personal destination calls with his/her terminal device as well as on the basis of identification of the person in at least one identification point. According to the invention in the method a passenger is identified at an identification point, on the basis of which the home floor of the passenger is determined and a destination call to the aforementioned home floor is generated for the elevator system if the passenger does not have a valid destination call at the time of identification.

A terminal device is e.g. a mobile phone or corresponding personal device, which can wirelessly transmit destination calls to the elevator system that are given by a passenger with a terminal device. A personal destination call in this context means that a destination floor is determined on the basis of identification data (an ID code) and/or identification data that identifies the passenger that gave a destination call is connected to the destination call. Destination calls can be given to the elevator system with a terminal device in the building and/or outside it, e.g. before the arrival of the passenger at an identification point.

Identification point refers in this context to an apparatus in a building, in the operating range of which apparatus a passenger can be recognized/identified. The identification of a passenger at an identification point can be based e.g. on the reading of a magnetic card, a barcode, an RFID (Radio Frequency Identifier) or an NFC (Near Field Communication) identifier, but also other identification methods, such as e.g. biometric identification, are possible. In one embodiment of the invention the identifier is integrated into a terminal device. An identification point can be integrated e.g. into connection with an access control gate, an automatic door or some other corresponding access control device. An identification point can also have information means for indicating the elevator allocated to the passenger in connection with the identification of the passenger.

A valid destination call means in this context that a passenger has given a personal destination call with his/her terminal device, or it has been generated on the basis of identification at an identification point, but the elevator system has not yet served the aforementioned destination call.

The present invention also discloses a system for generating destination calls for an elevator system, which comprises at least one elevator. The system comprises at least one identification point comprising means for identifying a passenger; means for registering personal destination calls that are given by a passenger with his/her terminal device; and an interface for linking the system to the elevator system. The system is arranged to identify a passenger at an identification point, to determine the home floor of the passenger on the basis of the aforementioned identification and to generate a destination call to the aforementioned home floor for the elevator system if the passenger does not have any valid destination calls.

In one embodiment of the invention a destination call given by a passenger with his/her terminal device is registered before the identification of the passenger at an identification point. When after this the passenger is identified at an identification point, the passenger is informed at the identification point of the elevator that has already been allocated to the passenger on the basis of the aforementioned destination call.

In one embodiment of the invention the travel time of a passenger from the identification point to the elevator allocated to the passenger is estimated in conjunction with the identification and the travel time, or data determining it, is transmitted to the elevator system. The travel time is taken into account in the control of the elevator system e.g. in such a way that the arrival time of the allocated elevator car at the departure floor of the passenger is matched with the estimated arrival time of the passenger.

In one embodiment of the invention a valid destination call of a passenger is removed from the list of calls to be served if the passenger who gave the destination call is not identified at an identification point within a given time window from the giving of the call, With the solution according to the invention numerous advantages are achieved with respect to solutions according to prior art. The solution according to the invention improves the transportation capacity of an elevator system because new destination calls are not generated for the same passenger if the passenger already has a valid destination call. By taking into account the travel time of a passenger from an identification point to the allocated elevator, or to the waiting lobby in general, the arrival of the allocated elevator can be optimally matched to the arrival of the passenger, which improves the transportation capacity of the elevator system. The transportation capacity is also improved by the fact that in the solution according to the invention those unnecessary destination calls given by a person who does not appear at an identification point in the assumed time, and who presumably does not—at least immediately—need elevator service, are removed from the list of calls to be served.

LIST OF FIGURES

In the following, the invention will be described in detail by the aid of a few examples of its embodiments, wherein:

FIG. 1 presents one system according to the invention.

DETAILED DESCRIPTION OF THE INVENTION

FIG. 1 presents one system according to the invention, said system being linked via an interface 111 to the control system 109 of an elevator system 100. The elevator system comprises elevators A and B. The system comprises a back-end system 110 of an access control system and also an access control gate 120. In connection with the access control gate is a locking device 122 for opening/closing the access control gate, a reader device 123 for reading electrical identifiers, e.g. for reading NFC identifiers, and also a display device 121 for informing about the elevator (A or B) serving the passenger identified at the access control gate. The reading distance of a reader device 123 is preferably a few centimeters from the identifier 110 forming the identification point 123'. The locking device 122 of the access control gate, the reader device 123 and the display device 123 are connected with a data transfer connection 125 to the back-end system 110.

In the possession of a passenger is a terminal device 102, e.g. a mobile phone, and also an identifier 101 for identifying the passenger at an identification point 123', e.g. an identifier based on NFC technology. The identifier 101 can be a separate identifier or integrated into the terminal device 102. The terminal device 102 is provided with software applicable to the purpose and with a user interface for giving personal destination calls and transmitting them to the back-end system 110. The data transfer connection 126 between the terminal device and the back-end system 110 is at least partly a wireless data transfer connection, e.g. a WAN, WLAN or corresponding connection.

When a person arrives at the building and with a terminal device 102 gives a destination call already in the entrance lobby F1, the terminal device sends the call data, and also the terminal device ID identifying the terminal device, to the back-end system 110. The terminal device ID is e.g. the MAC address of the terminal device, the ID code contained in an NFC identifier, a phone number or a corresponding individual ID code.

When the person arrives at an access control gate 120, he/she takes the identifier 110 into the reading range 123' of the reader device 123. The reader device 123 reads the ID code (NFC-ID) of the identifier and transmits it to the back-end system 110. Recorded in the database 108 of the back-end system for specific passengers are an NFC-ID and/or terminal device ID, information about the access rights of the passenger, and also valid destination calls. On the basis of the NFC-ID, the back-end system 110 checks the access rights of the person from the access control gate 120. If the access right is valid, the back-end system sends an opening command to the locking device 122 for admitting the passenger into the entrance lobby of the floor F1. In the same connection the back-end system 110 determines on the basis of the NFC-ID the home floor of the person, which home floor is recorded in the database 108 of the back-end system. If the person has not given a destination call with his/her terminal device 102 in the manner described above, and that being the case the passenger does not have a valid destination call, the back-end system sends via the interface 111 to the elevator system 100 a destination call (a so-called direct call) to the home floor of the person. The control system 109 of the elevator system allocates an elevator for the person and transmits the elevator data to the back-end system and onwards to the display device 123 of the access control gate, on which display device appears e.g. the text "Elevator B". If the person has already given a destination call with his/her terminal device 102 in the manner described above, the call is valid and a direct call to the home floor is not generated when the person is identified at an identification point 123' on the basis of an identifier 101. Since there is already information in the back-end system 110 about the elevator serving the person, the back-end system can display it on the display device 123 when the person is identified at the identification point 123', e.g. with the text "Elevator A".

If a person has gone from the access control gate 120 and the aforementioned direct call to the home floor has been registered to him/her, after this he/she can give a new destination call with his/her terminal device, in which case the system cancels the earlier direct call.

When a passenger gives a destination call with his/her terminal device 102 before his/her arrival at the access control gate 120, the back-end system 110 registers the moment the call was given and monitors whether the passenger arrives at the access control gate 120 and whether he/she is identified at the identification point 123' within a given time window from the moment the call was given, e.g. within 2 minutes of the call-giving moment. If the passenger is not identified at an identification point 123' inside the aforementioned time window, the back-end system 110 sends to the elevator system 100 a command for cancelling the aforementioned destination call that was given earlier.

Recorded in the database 108 of the back-end system is an assumed travel time from the identification point/access gate to the elevators A and B. When a passenger is identified at an identification point 123', the back-end system 110 sends to the elevator system 100 a passenger-specific travel-time estimate from the access gate 120 to the elevators A, B. In this embodiment the back-end system 110 connects to call data generated for the elevator system an individual ID code, e.g. an NFC-ID, so that the elevator system can later identify the call to which the travel-time estimate notified by the back-end system should be connected. The back-end system can transmit a travel-time estimate to the elevator system e.g. as a time estimate (e.g. in seconds), as a distance (e.g. in meters) or as an ID code of an identification point, on the basis of which the elevator system can itself estimate the travel-time estimate.

The invention is not only limited to be applied to the embodiments described above, but instead many variations are possible within the scope of the inventive concept defined by the claims. Thus, for example, the system according to the invention can be integrated at least partly into the elevator system.

The invention claimed is:

1. A method for generating destination calls for an elevator system comprising:

monitoring any destination call ordered by a passenger, including from a personal terminal device;

receiving an identification of the passenger in at least one identification point;

determining the home floor of the passenger from the identification;

generating a destination call to the home floor of the passenger if the valid destination call is not identified in said monitoring.

2. Method according to claim 1, wherein a destination call given by a passenger with his/her terminal device is registered before the identification of the passenger at an identification point; in conjunction with the aforementioned identification the passenger is informed of the elevator that has already been allocated on the basis of the aforementioned destination call.

3. Method according to claim 1 or 2, further comprising:

estimating the travel time of a passenger from the identification point to the elevator allocated to the passenger; wherein the aforementioned travel time is considered during control of the elevator system.

4. Method according to claim 1 or 2, wherein a destination call given by a passenger from his/her terminal device is removed from the list of destination calls to be served if the aforementioned passenger is not identified at an identification point within a given time window.

5. Method according to claim 1 or 2, wherein the passenger is identified from an RFID identifier, from an NFC identifier and/or from a biometric identifier.

6. A system for generating destination calls for an elevator system including at least one elevator, which system comprises:

a back-end system;

at least one identification point for identifying a passenger;

means for registering personal destination calls given by the passenger from his/her terminal device, the back end system including, a processor configured to identify a passenger at an identification point; to determine the home floor of the passenger on the basis of the aforementioned identification; and to generate a destination call to the home floor of the passenger to control the elevator system if the passenger does not have a valid destination call.

7. System according to claim 6, wherein a display device is provided in connection with an identification point, on which the system, in conjunction with identification, indicates to a passenger that the elevator is allocated to the passenger.

8. System according to claim 7, wherein the allocated elevator is allocated on the basis of a destination call given with a terminal device before the identification of the passenger at an identification point.

9. System according to any of the preceding claims 6-8, wherein the system removes a valid destination call of a passenger if the system does not identify the passenger at an identification point within a given time window.

10. System according to claim 6, wherein an identification point is in connection with an access control device such as an access gate or automatic door.

11. System according to claim 6, wherein an identification point comprises means for reading a personal identifier.

12. System according to claim 6, wherein the identifier is integrated into a terminal device.

13. System according to claim 6, wherein the system is arranged to estimate, in conjunction with identification, the travel time of a passenger to the allocated elevator and to transmit the aforementioned travel-time estimate, or data determining it, to the elevator system.

14. System according to claim 7, wherein an identification point is in connection with an access control device such as an access gate or automatic door.

15. System according to claim 8, wherein an identification point is in connection with an access control device such as an access gate or automatic door.

* * * * *